US010836130B2

(12) United States Patent
Schwelling

(10) Patent No.: US 10,836,130 B2
(45) Date of Patent: Nov. 17, 2020

(54) APPARATUS FOR COMPACTION OF CONTAINERS

(71) Applicant: Hermann Schwelling, Salem (DE)

(72) Inventor: Hermann Schwelling, Salem (DE)

( * ) Notice: Subject to any disclaimer, the term of this patent is extended or adjusted under 35 U.S.C. 154(b) by 1093 days.

(21) Appl. No.: 14/691,759

(22) Filed: Apr. 21, 2015

(65) Prior Publication Data

US 2015/0298415 A1 Oct. 22, 2015

(30) Foreign Application Priority Data

Apr. 22, 2014 (DE) ..... 10 2014 105 672

(51) Int. Cl.
*B30B 3/04* (2006.01)
*B30B 9/32* (2006.01)

(52) U.S. Cl.
CPC ..... *B30B 3/04* (2013.01); *B30B 9/325* (2013.01); *Y10S 100/902* (2013.01)

(58) Field of Classification Search
CPC ..... B30B 3/04; B30B 3/005; B30B 3/045; B30B 9/325; B02C 19/0087; B02C 19/0081; B02C 19/0093; B02C 4/08; B02C 4/30; B02C 18/142; B02C 18/182; Y10S 100/902
USPC ..... 100/155 R, 176, 902
See application file for complete search history.

(56) References Cited

U.S. PATENT DOCUMENTS 3,406,624 A 10/1968 Kutchera et al.
3,504,621 A * 4/1970 Qualheim ..... B30B 9/325 100/96
3,749,004 A 7/1973 Pagdin et al.
3,951,059 A * 4/1976 Morris ..... B30B 9/325 100/173
4,613,087 A 9/1986 Snyder
4,691,629 A * 9/1987 Koba ..... B30B 9/20 100/121
4,776,269 A * 10/1988 Coggins ..... B29B 13/06 100/168

(Continued)

FOREIGN PATENT DOCUMENTS

DE 85 15 290 U1 7/1985
DE 103 25 368 B4 11/2004

(Continued)

OTHER PUBLICATIONS

European Search Report from European Application No. 15 16 4745 dated Aug. 20, 2015.

(Continued)

*Primary Examiner* — Jimmy T Nguyen
(74) *Attorney, Agent, or Firm* — Collard & Roe, P.C.

(57) ABSTRACT

Apparatus for compaction of containers, particularly beverage cans or tin cans from the foods sector, having two pressure rolls disposed at a parallel distance from one another, forming a gap, which rolls can rotate about their axis of rotation, in each instance, and rotate in opposite directions, wherein their mantle surface has multiple essentially strip-shaped elements, in each instance, which reach longitudinally from one face surface to the opposite face surface of the pressure rolls, wherein the strip-shaped elements of each pressure roll are strip-shaped active elements, which each diverge at a setting angle relative to a reference line that runs parallel to its axis of rotation in the mantle surface.

17 Claims, 9 Drawing Sheets

(56) References Cited

U.S. PATENT DOCUMENTS

| | | | | |
|---|---|---|---|---|
| 4,796,680 | A * | 1/1989 | Koba | B27D 1/005 100/121 |
| 5,179,986 | A * | 1/1993 | Beuving | B27N 3/18 100/121 |
| 6,036,591 | A * | 3/2000 | Bonon | A22C 9/004 452/142 |
| 7,540,235 | B2 | 6/2009 | Schwelling | |
| 2006/0065770 | A1 * | 3/2006 | Hausman | B02C 4/08 241/285.1 |

FOREIGN PATENT DOCUMENTS

| | | | | |
|---|---|---|---|---|
| DE | 20 2008 008 568 | U1 | 10/2008 | |
| EP | 0367146 | A1 * | 5/1990 | B30B 9/325 |
| EP | 0 774 300 | A1 | 5/1997 | |
| EP | 0 774 300 | B1 | 3/2002 | |
| EP | 2 292 333 | A2 | 3/2011 | |
| FR | 2 501 535 | A1 | 9/1982 | |
| GB | 2 097 162 | A | 10/1982 | |
| JP | H04182097 | A | 6/1992 | |
| JP | H11-170095 | A | 6/1999 | |
| JP | 2004-322196 | A | 11/2004 | |
| WO | 2006094819 | A2 | 9/2006 | |
| WO | 2006094819 | A3 | 11/2006 | |

OTHER PUBLICATIONS

European Search Opinion from European Application No. 15 164 745.0 dated Aug. 20, 2015.

* cited by examiner

Detail A

Detail B

Detail B

APPARATUS FOR COMPACTION OF CONTAINERS

CROSS REFERENCE TO RELATED APPLICATIONS

Applicant claims priority under 35 U.S.C. § 119 of German Application No. 10 2014 105 672.8 filed on Apr. 22, 2014, the disclosure of which is incorporated by reference.

BACKGROUND OF THE INVENTION

1. Field of the Invention

The invention relates to an apparatus for compaction/compacting of containers, particularly cans made of tin plate, in particular beverage cans.

2. Description of the Related Art

Such apparatuses having one or more working rolls are used to compact empty containers (hollow bodies), particularly those from the foods sector, such as beverage cans and similar containers. In this way, the transport volume of the vehicle is better utilized for transport to recycling facilities; the transport costs are reduced. However, compacted containers are also advantageous for the recycling process itself.

A compacting device that has been known on the market for a long time is described in DE 85 15 290 U1. This apparatus possesses at least one roll for compaction and perforation of empty containers, wherein spines project radially from the base body of the roll. The spines are attached in radially oriented accommodations of the base body of the roll.

In DE 103 25 368 B4, a compacting apparatus for beverage containers in the form of plastic bottles and (tin) cans is disclosed, which comprises two rolls that can be driven in opposite directions, are disposed parallel at a distance from one another, and are configured in such a manner that empty containers are compacted between them, and their mantle surfaces, which face toward the rolls, are partly cut into. For this purpose, each roll has multiple disks along a roll axle. Some of the disks are configured as pressure disks, the other disks as cutting disks. Furthermore, the rolls are disposed in such a manner that cutting disks of the one roll engage into interstices between the disks of the other roll, in other words the cutting disks mesh with one another. By means of an opposite movement of the rolls, an empty container is drawn into the intake gap between the rolls and compacted and partly cut into by the plurality of pressure and cutting disks. This particularly allows also compacting of empty, closed containers, without having to first perforate them.

An apparatus for compacting of containers, particularly of PET bottles and tin cans, is described by DE 20 2008 008 568 U1. This apparatus has a roll that can be driven by a motor, so as to rotate, opposite which roll a curved counter-bearing surface lies. The distance between this counter-bearing surface and the circumference surface of the roll decreases in the direction of rotation of the roll, so that a space that narrows in wedge shape is formed in the direction of rotation of the roll. The circumference surface of the roll is composed of level surface sections that are lined up with one another. Entrainment elements that extend radially outward and can have the form of strips, for example, are disposed at the abutting edges between the individual surface sections. These strips extend over the entire length of the roll and are configured to be straight. Depending on the type of the level surface sections of the roll circumference surface, the entrainment strips either run parallel to the axis of the roll or at a slant relative to it.

Further apparatuses for compacting of containers are described in JP 11 170095 A and FR 2 501 535 A1. Both apparatuses possess two rolls driven to run opposite one another, between which an intake gap for empty material to be compacted is formed. Intake elements, among other things, are disposed on the circumference surfaces of the rolls, which elements extend continuously in the longitudinal roll direction, over the entire roll length, and are disposed parallel to one another. These intake elements have the form of a V, the tip of which is directed opposite to the direction of rotation of the rolls.

A further apparatus for compacting of empty cans is disclosed in JP 2004 322196 A. This apparatus possesses two rolls driven in opposite directions, between which a roll gap for drawing in empty cans is formed. Both rolls possess strips that run in screw shape on their circumference surface as intake elements. In this apparatus, it is true that the compressed bodies ejected from the apparatus are now flat as compared with their starting shape, but they are strongly curved in banana shape, in particular.

On the market, there continues to be a demand for more efficient apparatuses for compacting of hollow bodies/containers from the foods sector. In this connection, efficiency is also understood to mean lengthening the maintenance intervals and reducing the maintenance effort and expenditure.

SUMMARY OF THE INVENTION

Proceeding from the solutions according to the state of the art, an apparatus for compaction of containers, particularly beverage cans or tin cans from the foods sector, at least modules for such apparatuses, are supposed to be found, which apparatus brings about a reduction in the production costs as well as the operating costs during use, and particularly achieves energy savings. Furthermore, the quality of the compacted hollow bodies/containers is supposed to be improved for the subsequent recycling process as well as for voiding of disposable containers on which a deposit is collected.

The task is accomplished by means of an apparatus for compaction of containers, particularly beverage cans or tin cans from the foods sector, having the characteristics according to the invention.

Exemplary embodiments of the apparatus according to the invention are disclosed below.

As compared with known solutions, in this connection the advantages of the invention consist, aside from savings in the production of the apparatus, such as, for example, the production effort and expense for the rolls, the assembly effort for the apparatus, and the energy savings for the production of the apparatus parts, also in lowering of the operating costs at the user's location, particularly by means of energy savings during operation of the apparatus by up to 50%, by means of reduced maintenance effort and expenditure, and, among other things, by means of reduced wear of the rolls.

Furthermore, the bodies compacted using the apparatus according to the invention have greater shape stability, so that in the subsequent recycling process, fewer disruptions occur during conveying of the compacted bodies, among other things; in the recycling machines themselves and also toward the recycling machine.

Furthermore, during compaction of the containers, bent edges having a small radius, in the compacted body wall and bottom of the containers, are avoided to the greatest possible extent, so that the number of stress whitening spots in the material, in other words in the flattened body walls of the containers, is significantly reduced. At the same time, however, it is guaranteed that voiding of deposit containers is reliable, in other words the barcode placed on the outer mantle surface of the containers/hollow bodies is voided.

One aspect of the invention is a newly configured pressure roll for the apparatus according to the invention, which roll is profiled in a new manner in the periphery of its working region, in other words its mantle surface.

This pressure roll according to the invention is provided in duplicate in the new apparatus. The two pressure rolls are mounted so as to rotate, and spaced apart from one another to form a gap. The gap is disposed parallel to the respective axis of rotation of the pressure rolls. Initially, this gap is the intake gap, then—directly between the pressure rolls—the working gap, and then the exit gap, which opens into an exit opening provided in the housing of the apparatus.

Multiple strip-shaped elements that reach longitudinally from one face surface to the opposite face surface of the body of the pressure rolls are provided in the mantle surface of these new pressure rolls, which surface is essentially cylindrical, in each instance.

Preferably, these strip-shaped elements, which are, according to the invention, multiple-action elements for intake, for perforation of the containers, if necessary, for compaction, and for ejection, are formed by grooves longitudinally disposed in the mantle surface of each pressure roll. In other words, a strip-shaped active element is disposed/formed between two adjacent grooves, in each instance. The grooves are of the same type and same width, and run parallel to the axis.

Preferably, the grooves and thereby also the strip-shaped active elements are provided distributed uniformly on the circumference.

In the apparatus according to the invention, the strip-shaped active elements of each pressure roll are disposed diverging at a setting angle relative to a reference line that runs in the mantle surface, parallel to its axis of rotation.

According to embodiments of the invention, the setting angle of each strip-shaped active element has the same size, preferably has a value between 0.1° and 40°, and particularly a value of 15°.

According to a further embodiment of the invention, the strip-shaped active elements, seen in cross-section, have a trapezoid shape. In a first embodiment, the trapezoid shape is not symmetrical, and in a second embodiment, the trapezoid shape is symmetrical. This trapezoid shape is formed, in each instance, by side surfaces that are directed outward, are spaced apart from one another, and lie opposite one another, which surfaces are connected, on the head side, by means of a pressure surface. This pressure surface is the part of the mantle surface of each pressure roll that is not broken up by working in the grooves.

In the embodiment with the non-symmetrical trapezoid shape of the strip-shaped active elements, the side surface of the active elements that lies on the front side, in other words faces in the direction of rotation, is disposed at an inclination angle to a radius line that runs through the edge formed by the intersection point of this front surface and the adjacent pressure surface that lies at the top. This inclination angle preferably lies in a value range between 1° and 20°, particularly between 8° and 12°.

In yet another improved embodiment, the radius line that delimits the angle does not run through the said edge, but rather inward on the body by 0.1 mm to 1.5 mm from the said edge of the active element.

The height of these strip-shaped active elements with reference to the root of the groove that lies next to it, in each instance, preferably has an amount of 2 to 6 mm; in particular, this height is 4.25 mm.

The side surface of the strip-shaped active elements that lies in the front, in the direction of rotation, and the side surface of the leading strip-shaped active element, in each instance, that lies at the back, are disposed, relative to one another, at an angle between 70° and 30°, preferably at an angle of 54° to 62°.

In a further embodiment having the symmetrical trapezoid shape of the strip-shaped active elements, the side surface that lies on the front side in the direction of rotation of the pressure roll is disposed at an inclination angle to a radius line that symmetrically divides the strip-shaped active element. This inclination angle preferably lies in a value range between 15° and 45°, between 25° and 40°.

The height of the strip-shaped active elements with reference to the root of the groove lying next to it, in each instance, preferably has an amount of 2 to 5 mm; advantageously, this height is 3.5 mm.

The side surface of the strip-shaped active elements that lies on the front side and the side surface of the leading strip-shaped element that lies at the back, in each instance, are disposed, relative to one another, at an angle between 120° and 60°, preferably at an angle of 82° to 95°.

Preferably, the pressure rolls according to the invention are produced from solid material and from quenched and tempered steel, and their mantle surface along with the strip-shaped active elements are at least surface-hardened.

A further embodiment of the invention is such that the bearing journals of the pressure rolls, which are passed through the side walls and guided and held in bearings disposed outside of the side walls, are sealed at least twice with regard to the related openings in the side walls, specifically by means of at least one radially acting seal and at least one axially acting seal.

BRIEF DESCRIPTION OF THE DRAWINGS

The invention will be explained further and in greater detail using exemplary embodiments shown in drawings, which embodiments do not, however, restrict the invention. The drawings show.

DETAILED DESCRIPTION OF THE PREFERRED EMBODIMENTS

In the following description of the exemplary embodiments, terms such as "at the top," "at the bottom," "on the left," and "on the right" relate only to the figures in question and can therefore deviate from reality. Also, the proportions can be different, in reality, from the figures. Furthermore, the figures are not precise technical drawings, but rather are merely supposed to show the nature of the invention. With regard to the reference symbols, it is noted that the same numbers in the different figures always refer to the same components. Reference symbols not mentioned in the description are evident from the reference symbol list or from being mentioned in another figure of this disclosure. The reference numbers used in the figures have the same meaning, in each instance, even if they are not explicitly mentioned with regard to every figure in the description of the embodiments.

Figure 1:
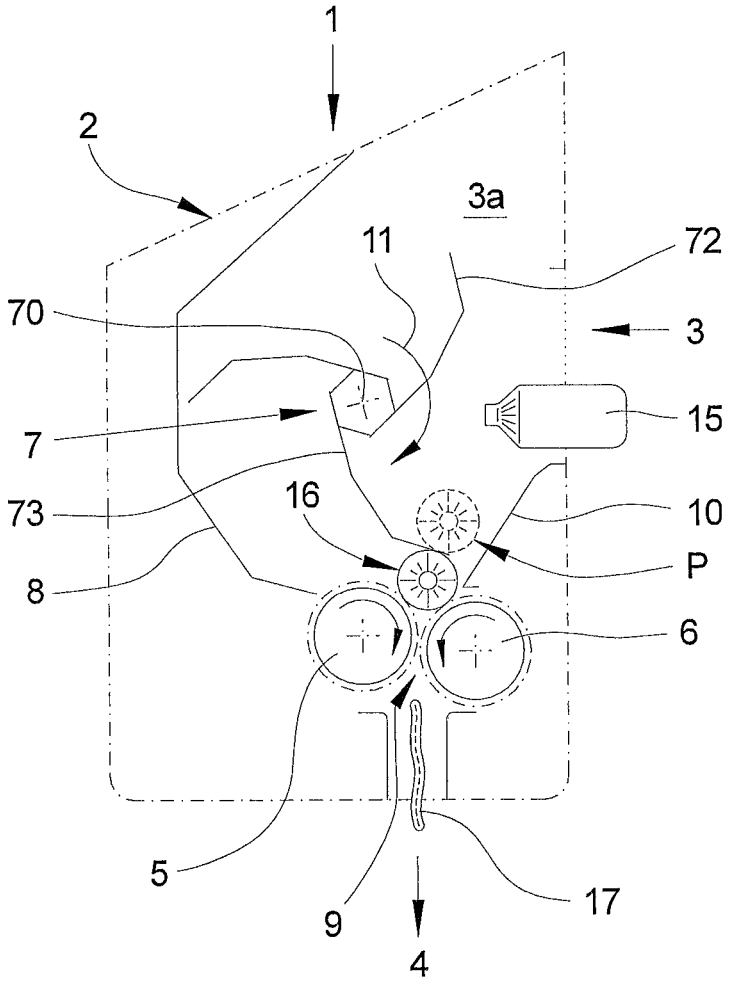
FIG. 1 a schematic side view of an apparatus according to the invention with a view into the working space of this apparatus.

A schematic side view of an apparatus having a pressure roll 5 according to the invention and a pressure roll 6 according to the invention is shown in FIG. 1. Here, one of the lateral housing walls has been removed, so that the view is open into the working space of the apparatus.

In a housing 2, a filling opening 3 is provided on one side, in an upper region, for throwing in the said containers/hollow bodies 15 that are to be recycled. In the upper inner region, there is a feed chamber 3*a*; in the lower region of this housing 2, following the feed chamber 3*a*, the first pressure roll 5 is disposed, and, lying opposite to it, parallel, and at a distance from it, the pressure roll 6, which is the same as the pressure roll 5 according to the invention, in terms of type and embodiment. It, the pressure roll 6, is merely rotated by 180°, so that the left face side of the pressure roll 5 is then the right face side of the pressure roll 6.

The pressure roll 5 and the pressure roll 6 form a gap 9 between them. This gap is an intake gap, working gap, and ejection gap at the same time. The containers 15, 16, etc. to be compacted are introduced into the feed space 3*a* by way of the fill-in opening 3, one after the other, and slip down to the gap 9 by way of the chute 10. An entrainment unit 7 is disposed in the feed space 3*a* and supports the feed of the containers 15 or 16 that are thrown in, to the gap 9, with one of its vanes 71, 72 or 73, in each instance, which move according to arrow 11; this gap is the intake gap, wherein these vanes push the container in the direction of the gap and, at the same time, press it against this intake gap, as long as they have contact with the container.

The containers that are thrown in are reliably drawn in and compacted by means of the pressure rolls 5 and 6 that rotate in opposite directions, i.e. by their strip-shaped active elements 59 and 69, which act crosswise in the intake gap and working gap, according to the invention. The sections of the wall of the containers that are pressed against one another, which wall then has a double layer in the working gap, is accordingly reliably compacted in accordance with the explanations already provided above. Any deposit markings that might be present are effectively voided. The double-layer body, in the compacted state, contains an embossed-like shaping at least in certain sections, which shaping is such, because of the rotation and the strip-shaped active elements disposed in a new manner, that hooking of the said sections into one another more or less takes place. According to the invention, the strip-shaped active elements, here, in the exemplary embodiment shown, the strip-shaped active elements 59 and 69 of the pressure roll 5 and 6, respectively, are disposed in such a manner that they possess the same setting angle W1. During the installation/assembly of these pressure rolls in the apparatus, attention must be paid to ensure that this setting angle W1 is approximately the same on both pressure rolls, i.e. for the respective strip-shaped active elements.

In the representation shown in FIG. 1 (an instantaneous image of the working apparatus) it is the vane 73 that presses the container/hollow body 16 against the pressure rolls 5 and 6 and into the intake section of the gap 9. The next container 15 fed in is shown in two positions. Once while being thrown in and in a later position P, in terms of time; here, the container 15, introduced in the longitudinal direction, is drawn with a broken line for differentiation. It now lies crosswise, in other words parallel to the pressure rolls 5 and 6 and the intake gap formed between them, in terms of its longitudinal orientation, and waits, in this position P, for transfer to the intake gap of the gap 9 by means of advancing gravity feed along the chute 10 and/or the rear side of the vane 73. The subsequent vane 72 will then likewise press the container 15 up to the intake gap 9 and into it as the entrainment unit 7 continues to rotate about its axis of rotation 70, as is shown in this figure with regard to the container 16.

Preferably, the entrainment unit 7 is a separator according to EP 2 292 333 A2 or U.S. Pat. No. 7,540,235 B2. Not shown here are known modules and components that belong to an apparatus of this type, such as, for example, a gear mechanism and a motor, as well as a control unit, which are required for operation of the apparatus and are also provided here.

Figure 2:
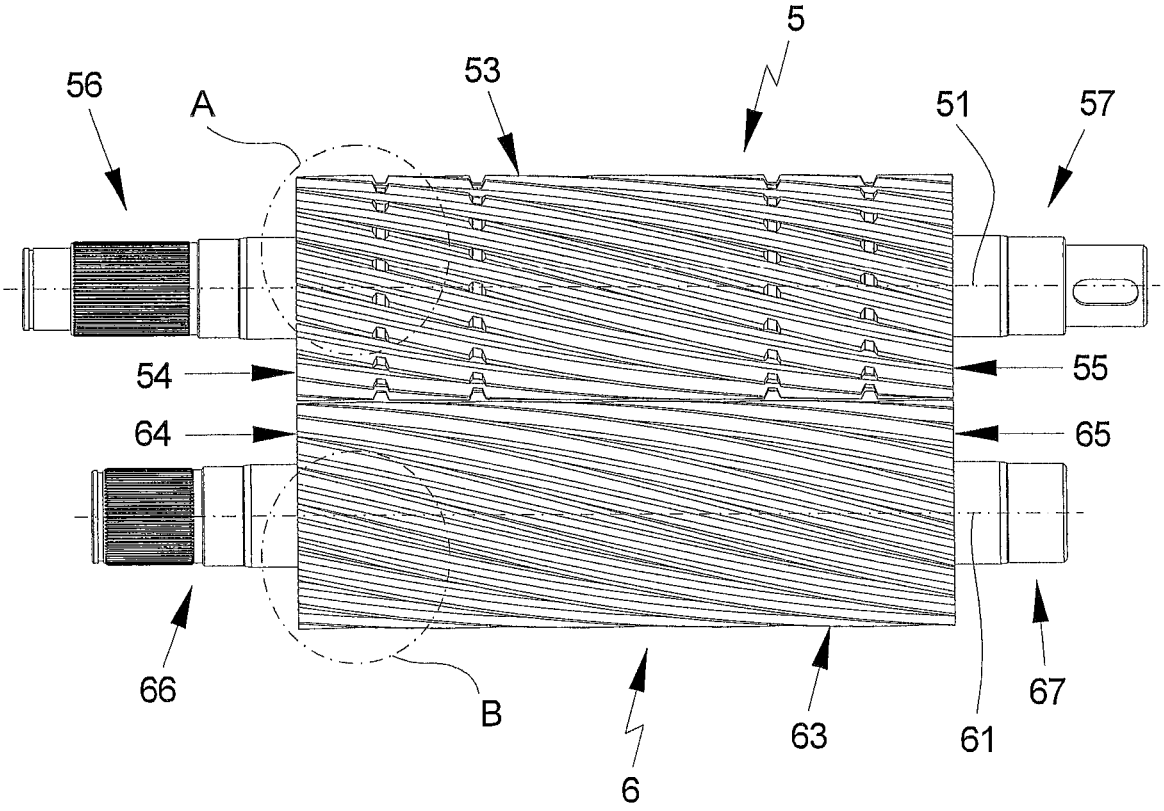
FIG. 2 the pressure rolls of the apparatus according to FIG. 1, which rolls are assigned to one another.
Figure 2A:
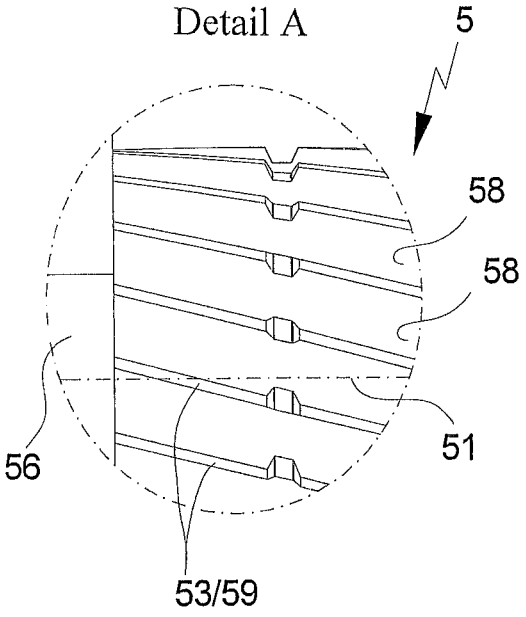
FIG. 2*a*, 2*b*, 2*c* details of the pressure rolls according to FIG. 2.

In FIG. 2, in a schematic view, the pressure rolls 5 and 6 of the new apparatus from FIG. 1, assigned to one another, are shown in a top view. The first pressure roll 5 is situated at the top. It possesses an axis of rotation 51, bearing journals 56 and 57 at the side, as well as a roll body having a mantle surface 53, between the left face surface 54 and the right face surface 55. Further details are shown in FIG. 2*a*, with regard to detail A. A plurality of grooves 58 has been sunk longitudinally into the mantle surface 53. These grooves 58 are uniformly distributed on the circumference of the first pressure roll 5. A strip-shaped active element 59 is formed between two grooves, in each instance, which element also reaches longitudinally from the left face surface 54 all the way to the right face surface 55.

In this FIG. 2, the second pressure roll 6 is disposed underneath the first pressure roll 5, at a parallel distance from the aforementioned first pressure roll 5. The distance between the two pressure rolls 5 and 6 is the gap 9 (see also FIG. 1).

The second pressure roll 6 possesses an axis of rotation 61, bearing journals 66 and 67 at the side, as well as a roll body having a mantle surface 63 between the left face surface 64 and the right face surface 65.

Figure 2B:
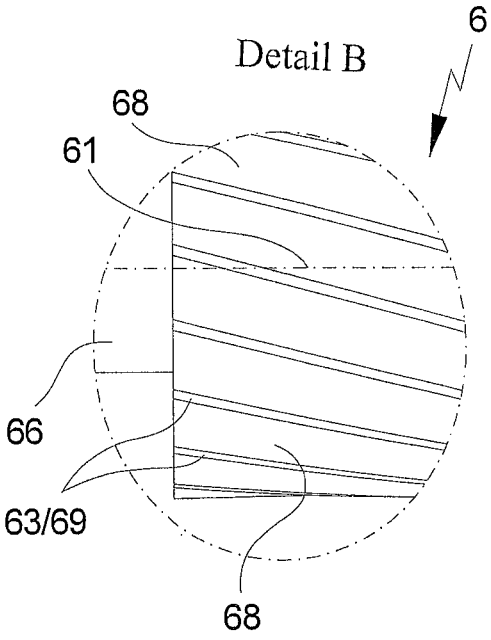

Further details are shown in FIG. 2*b* with regard to detail B. A plurality of grooves 68 has been sunk longitudinally into the mantle surface 63. These grooves 68 are uniformly distributed on the circumference of the second pressure roll 6. A strip-shaped active element 69 is formed between two grooves, in each instance, which element also reaches longitudinally from the left face surface 64 all the way to the right face surface 65.

Figure 2C:
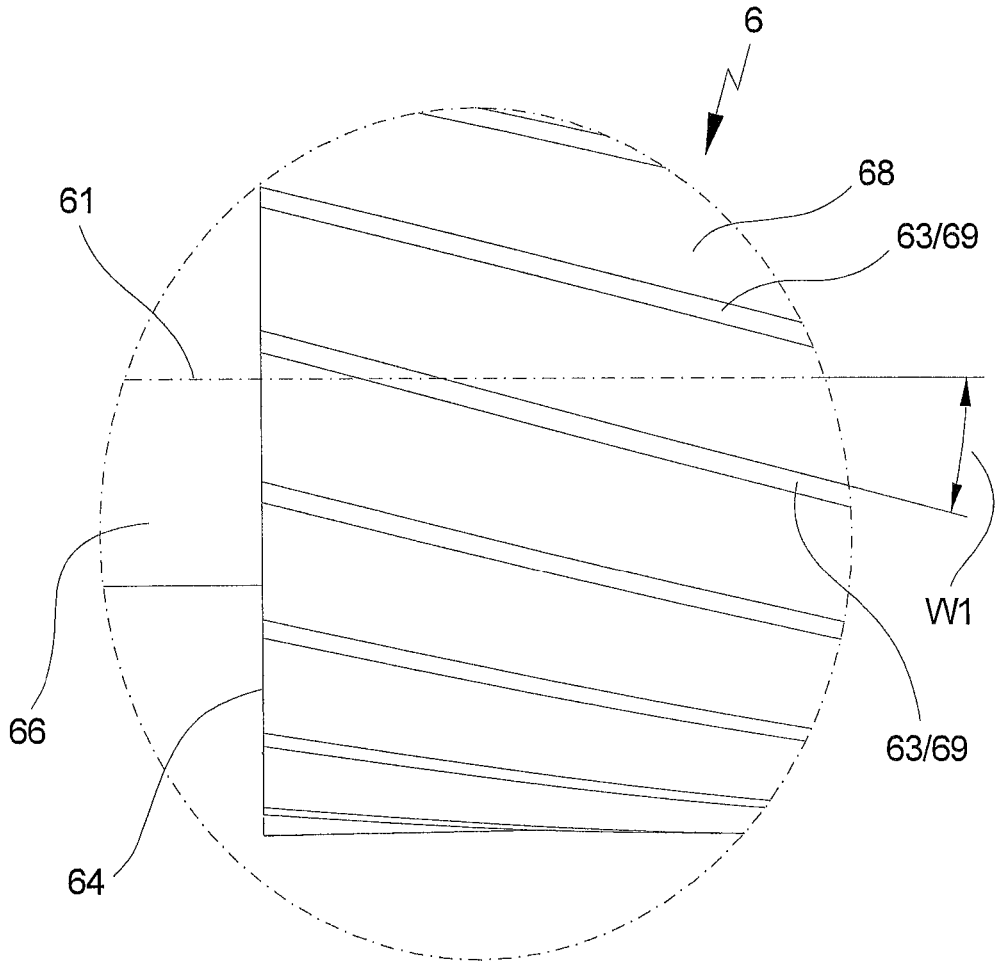

In FIG. 2*c*—here with reference to detail B—further details of the pressure rolls are shown. The strip-shaped active elements of the pressure rolls—here shown using the example of the pressure roll 6—diverge at a setting angle W1 relative to a reference line that runs parallel to its axis of rotation 61 in the mantle surface 63. The strip-shaped active elements—here the elements 69—are disposed oriented to reach in a straight line from the left face surface 64 all the way to the right face surface 65.

Figure 3:
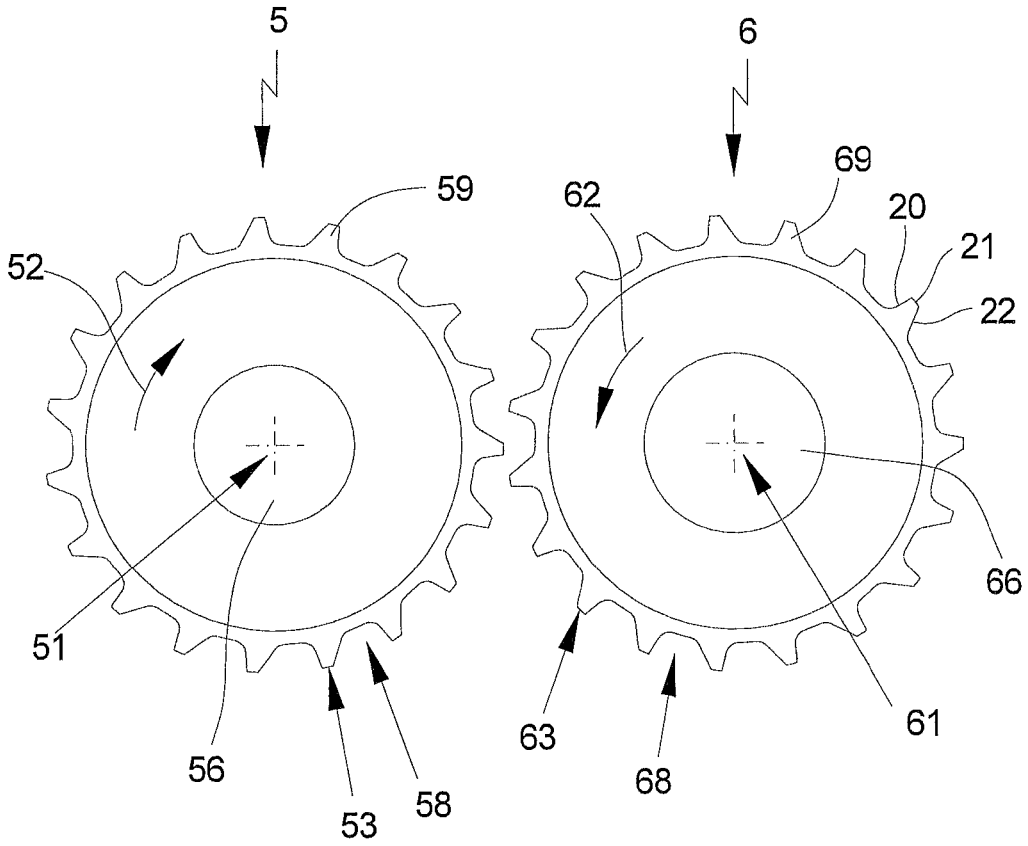
FIG. 3 the pressure rolls according to FIG. 2 with a first embodiment of strip-shaped active elements.
Figure 3A:
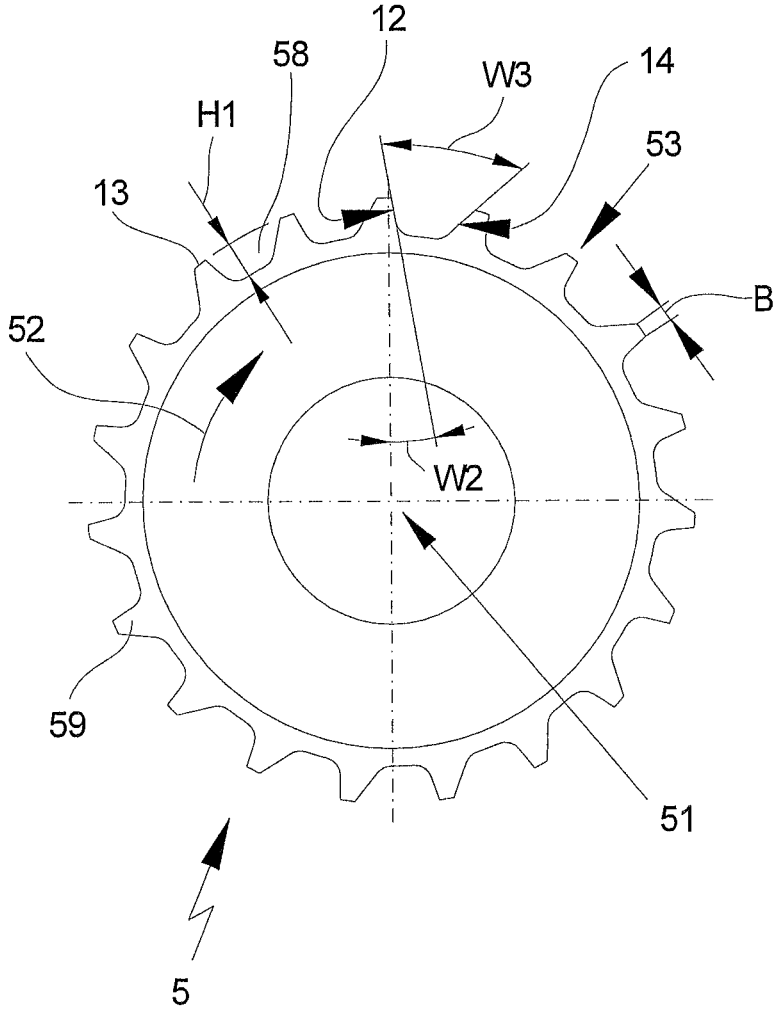
FIG. 3*a* details regarding FIG. 3.

In FIGS. 3 and 3*a*, the pressure rolls 5 and 6 are equipped with strip-shaped active elements 59 or 69 according to a first embodiment type. The respective direction of rotation is indicated with the reference symbol 52 and 62.

The strip-shaped active element 59 disposed between two grooves 58, in each instance, possesses a front-side side surface 12, which will also be called front surface hereinafter, and a side surface 14 that lies opposite, which will also be called rear surface hereinafter. Outward from the body, the two side surfaces are connected with one another by means of the section of the mantle surface 53 that still remains. This section of the mantle surface 53 is the pressure surface 13.

The front surface 12 is disposed at an inclination angle W2 relative to the radius line, which runs through the edge formed by the intersection point of the front surface 12 and the adjacent pressure surface 13 that lies at the top. In this embodiment, this inclination angle W2 preferably amounts to approximately 10°. The front surface 12 and the rear surface 14 of the leading strip-shaped active element are preferably disposed at a distance/angle W3 of preferably approximately 58° relative to one another.

The second pressure roll 6 also shown in FIG. 3, which is disposed more or less as a mirror image to the pressure roll 5 in the apparatus, has the same shape/shaping, as has already been said. There, the strip-shaped active elements 69 have a side surface/front surface 20, a side surface/rear surface 22, and a pressure surface 21. The inclination angle W2 of the front surface 20 and the distance/angle W3 are of the same type and embodiment as in the first pressure roll 5.

Figure 4:
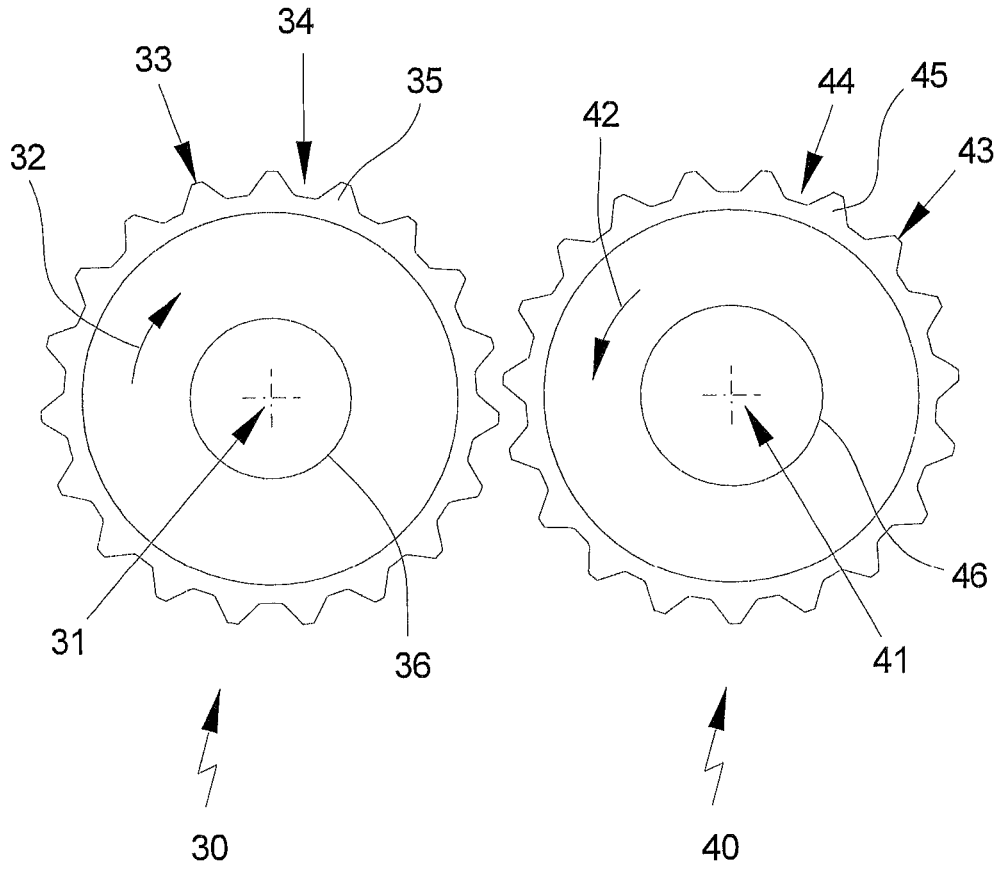
FIG. 4 the pressure rolls according to FIG. 2, with a second embodiment of strip-shaped active elements.
Figure 4A:
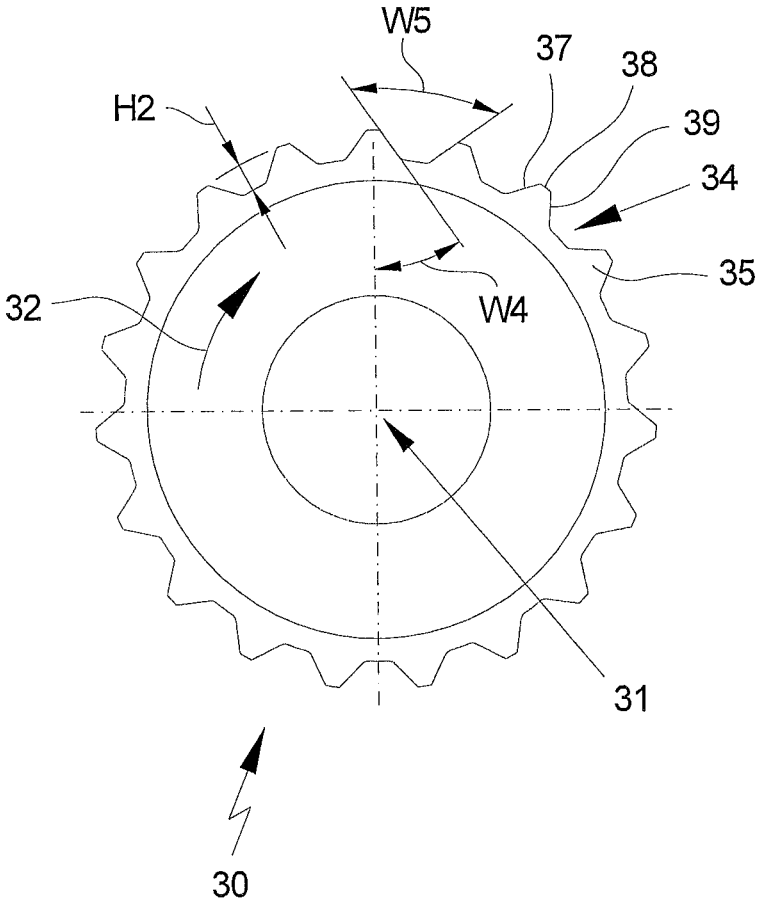
FIG. 4*a* details regarding FIG. 4.

In FIGS. 4 and 4*a*, the pressure rolls, here the pressure rolls 30 and 40, are equipped with strip-shaped active elements 35 and 45 according to a second embodiment type. The respective direction of rotation is indicated with the reference symbol 32 and 42.

The strip-shaped active element 35 disposed between two grooves 34, in each instance, possesses a front-side side surface 39, which will also be called front surface hereinafter, and a side surface 37 that lies opposite, which will also be called rear surface hereinafter. Outward from the body, the two side surfaces are connected with one another by means of the section of the mantle surface 33 that still remains. This section of the mantle surface 33 is the pressure surface 38.

The front surface 39 is disposed at an inclination angle W4 relative to the radius line, which symmetrically divides the strip-shaped active element 35. In this embodiment, this inclination angle W4 preferably amounts to approximately 35°. The front surface 39 and the rear surface 37 of the leading strip-shaped active element 35 are preferably disposed at a distance/angle W5 of preferably approximately 89° relative to one another.

The second pressure roll 40 of the second embodiment, also shown in FIG. 4, which is disposed more or less as a mirror image of the first pressure roll 30 of the second embodiment in the apparatus, has the same shape/shaping, as was already said above. There, the strip-shaped active elements 45 have a similarly shaped front surface, rear surface, and pressure surface, which are not specifically labeled in this figure; the reference symbols 37, 38, and 39 of the first pressure roll 30 of the second type have the same meaning on this second pressure roll 40.

The inclination angle W4 of the front surface 39 and the distance/angle W5 are of the same type and embodiment as in the first pressure roll 30 of the second type.

Figure 5:
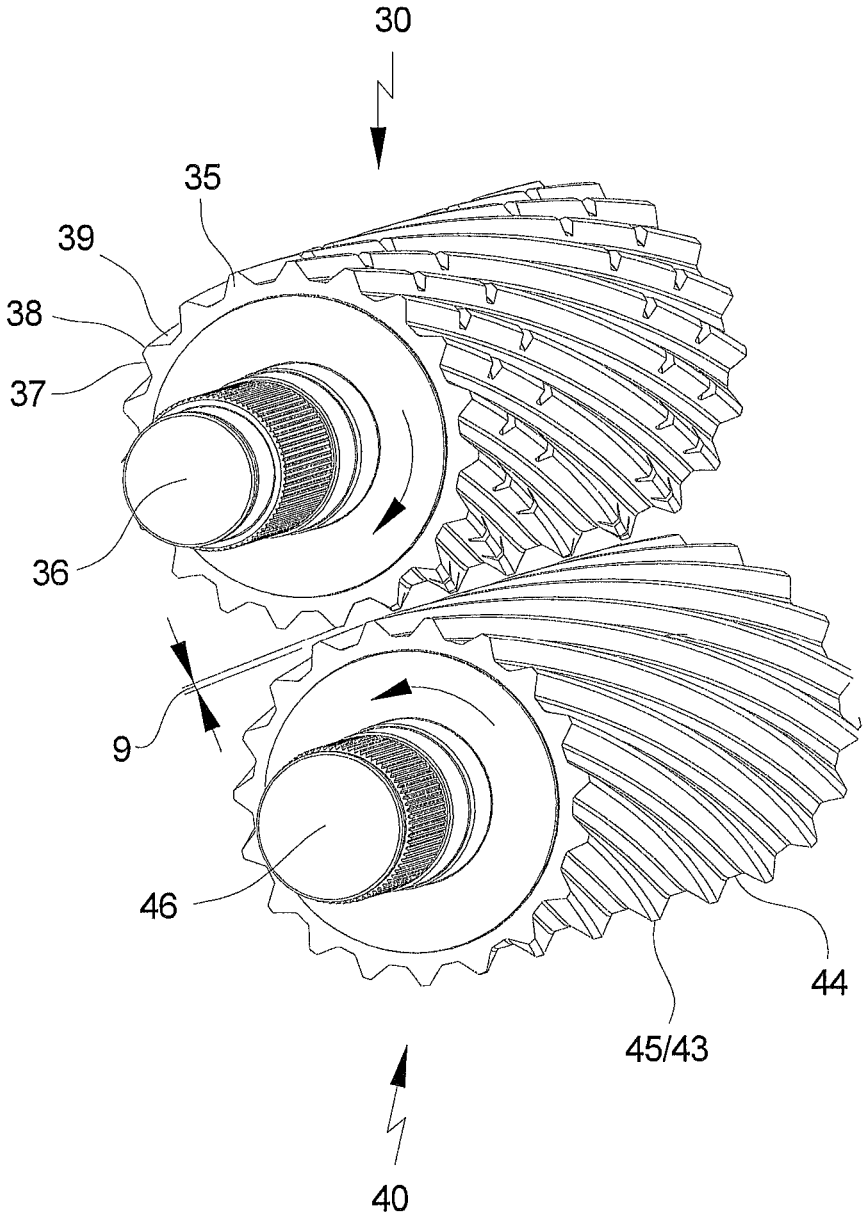
FIG. 5 a perspective view of pressure rolls of the apparatus according to the invention, with strip-shaped active elements of a second embodiment.

The roll pair shown in FIG. 4, with the pressure rolls 30 and 40 according to the invention, is shown in a perspective view in FIG. 5. The view is at the left face surface with the bearing journals 36 and 46. In this view, it can be clearly seen that the longitudinal strip-shaped active elements—here with the reference symbols 35 and 45—do possess a setting angle W1 directed in the same direction (not drawn in here), but then intersect in the gap 9 (in the intake region, in the working region, and in the ejection region).

As the result of the similar structure of the pressure rolls 30 and 40, their mirror-image installation in the apparatus, as well as their opposite direction of rotation, this "crossing" of the strip-shaped active elements, which is advantageous in terms of effect, is implemented in simple manner and furthermore cost-advantageously. This advantage also occurs with the roll pair that is formed by the pressure rolls 5 and 6, which pair is shown in FIG. 2.

The "crossing" of the strip-shaped active elements in the gap 9 formed between the pressure rolls 5 and 6 or 30 and 40, as well as the further details of the form of the strip-shaped active elements and their placement on or in the mantle surface of the pressure rolls and the position at a setting angle W1 relative to the line parallel to the axis in the mantle surface of the pressure roll, with reference to its axis of rotation, have a particularly positive effect on problem-free drawing of the containers in between the pressure rolls and on reliable hooking of the wall sections of the containers, which are pressed against one another. The containers that are flattened as the result of compaction between the pressure rolls remain in this state that has been produced. As compared with the known apparatuses, significantly greater shape stability of the flattened containers is achieved with the apparatus according to the invention; furthermore, the number of bent edges having a small radius, in the body wall of the compacted containers, is reduced by a multiple, so that the formation of stress whitening spots, in particular, in the body wall and/or "splitting off" or projection of small, some more or less cut wall sections, which reduce the value of the containers, is avoided.

Figure 6:
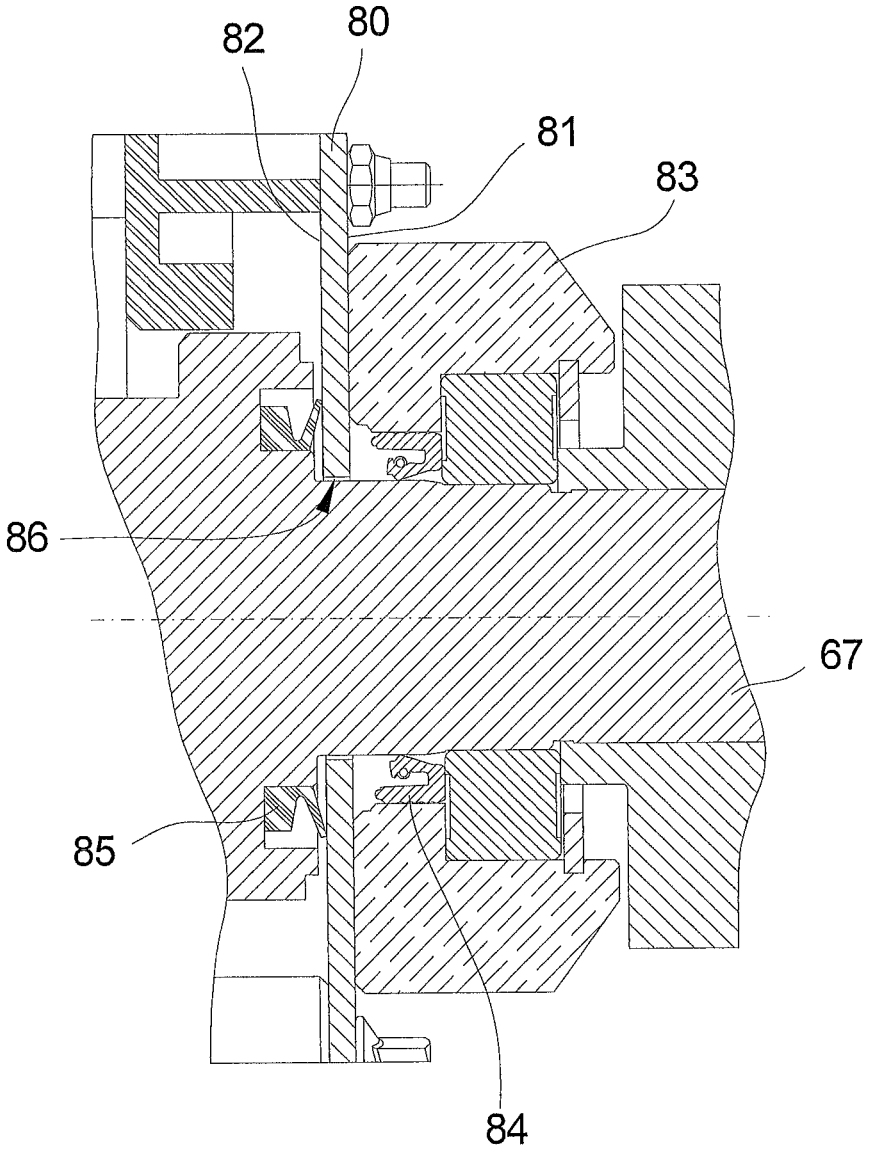
FIG. 6 in a sectional representation, mounting of the pressure rolls of the new apparatus having a new type of seal.

In FIG. 6, in a schematic sectional representation, a further embodiment of the apparatus according to the invention is shown, by means of which the maintenance effort and expenditure, in particular, and the maintenance interval are positively influenced, because suspended solids and liquids from the work space of the apparatus are kept away from the bearings for the bearing journals of the pressure rolls, significantly better than in the case of known solutions. Specifically, it is provided, according to this solution, that on the inside of the passage opening 86 for a bearing journal—here the bearing journal 67 of the second pressure roll 60 according to FIG. 2—an axially acting seal 85 is disposed on the inner side 82 of the bearing plate 80, and a radially acting seal 84 is disposed in the region of the outer side 81 of the bearing plate 80, on the bearing journal 67 that is passed through the passage opening 86.

This second, radially acting seal 84, does not lie directly against the outer side 81 of the bearing plate. In this way, the result is achieved that possibly, suspended solids and liquids that do pass by the axially acting seal 85 are drained away downward in the region of the passage opening 86, which possesses an additional longitudinal groove at the lower point—in the installed position—which groove is furthermore preferably inclined relative to the horizontal. The longitudinal groove not shown in the figure acts to support this.

The invention is not restricted to the exemplary embodiment that has been shown and described, but rather particularly also comprises variants that can be formed by means of a combination of characteristics and elements described in connection with the present invention. Furthermore, individual characteristics or methods of functioning described in connection with the figures can represent an independent invention, in and of themselves. The applicant therefore reserves the right to claim characteristics that are of essential significance for the invention, which have only been disclosed in the description until now, particularly in connection with the figures. The claims submitted with this application are therefore only proposed formulations, without prejudice to achieving further patent protection.

REFERENCE NUMBER LIST

1 apparatus
2 housing
3 fill-in opening
3*a* feed space
4 exit opening
5 first pressure rolls
  51 axis of rotation
  52 direction of rotation
  53 mantle surface
  54 left face surface
  55 right face surface
  56 bearing journal
  57 bearing journal
  58 grooves (longitudinal in item 53)
  59 strip-shaped active elements
6 second pressure roll
  61 axis of rotation
  62 direction of rotation
  63 mantle surface
  64 left face surface
  65 right face surface
  66 bearing journal
  67 bearing journal
  68 grooves (longitudinal in item 63)
  69 strip-shaped active elements
7 entrainment unit
  70 axis of rotation of item 7
  71, 72, 73 vanes of item 7
8 guide plate
9 gap (intake gap, perforation gap, working gap and ejection gap)
10 chute
11 arrow
12 side surface (front surface of item 59)
13 pressure surface (on item 59)
14 side surface (rear surface of item 59)
15, 16 container (container fed in, e.g. beverage cans, tin cans from the foods sector)
17 compacted container
20 side surface (front surface of item 69)
21 pressure surface (on item 69)
22 side surface (rear surface of item 69)
30 first pressure roll of second type
31 axis of rotation
32 direction of rotation
33 mantle surface
34 grooves (longitudinal in item 33)
35 strip-shaped active elements
36 bearing journal
37 side surface (rear surface of item 35)
38 pressure surface (on item 35)
39 side surface (front surface of item 35)
40 second pressure roll of second type
41 axis of rotation
42 direction of rotation
43 mantle surface
44 grooves (longitudinal in item 43)
45 strip-shaped active elements
46 bearing journal
80 bearing plate
81 outside
82 inside
83 bearing
84 radially acting seal
85 axially acting seal
86 passage opening (in item 80)
H1 height (of item 59 with reference to groove root)
H2 height (of item 35 with reference to groove root)
W1 setting angle between the strip-shaped active element (59, 69, 35 or 45) and the line, parallel to the axis, in the mantle surface of the pressure roll
W2 angle of inclination between the front surface 12 or 20 of the strip-shaped active element 59 or 69 and the radius line that runs through the edge formed by the intersection point of the front surface and the adjacent pressure surface 13 or 21
W3 distance/angle between the front surface 12 or 20 and the rear surface 14 or 22 of the next strip-shaped active element 59 or 69 that leads in the direction of rotation
W4 angle of inclination between the front surface 39 of the strip-shaped active element 35 and the radius line that symmetrically divides the strip-shaped active element 35
W5 distance/angle between the front surface 39 and the rear surface 37 of the next strip-shaped active element 59 or 69 that leads in the direction of rotation

The invention claimed is:

1. An apparatus for compaction of containers, comprising two pressure rolls, which rolls can rotate about their axis of rotation, in each instance, and rotate in opposite directions, wherein a plurality of grooves has been sunk longitudinally into their mantle surface, so that their mantle surface has the form of multiple essentially strip-shaped elements with planar pressure surfaces being in areas of the mantel surface without grooves, in each instance, which reach longitudinally from one face surface to the opposite face surface of the pressure rolls, wherein the two pressure rolls are disposed at a parallel distance from one another, forming a gap defining a minimum distance between the planar pressure surfaces of the mantle surfaces of the two pressure rolls along a direction from one axis of rotation to the other, wherein the strip-shaped elements of each pressure roll are strip-shaped active elements, which each diverge at a setting angle relative to a reference line that runs parallel to its axis of rotation in the mantle surface, wherein for one pressure roll the strip-shaped elements diverge with said setting angle of said strip-shaped element in rotation direction of the one pressure roll from the reference line while with the other pressure roll the strip-shaped elements diverge with said setting angle of said strip-shaped element against the rotation direction of the other pressure roll, so that the strip-shaped elements are crosswise to each other when adjacent to the gap, wherein each of the strip-shaped active elements lies between two of the grooves, in each instance, wherein each groove comprises a planar groove root and each strip-shaped element comprises a planar pressure surface, wherein a width of each planar pressure surface is smaller than a width of each planar groove root, wherein when the strip-shaped elements are adjacent to the gap, the planar pressure surfaces of the strip-shaped elements of the one pressure roll and the planar pressure surfaces of the other pressure roll face each other along a direction from one axis of rotation to the other, wherein when the strip-shaped elements are adjacent to the gap, the planar pressure surfaces of the striped-shaped elements of one pressure roll are spaced apart from the planar pressure surfaces of the striped-shaped elements of the other pressure roll along the direction from one axis of rotation to the other by the minimum distance, and wherein the strip-shaped elements of one of the pressure rolls comprise grooves separating each strip-shaped element into at least two segments.

2. The apparatus according to claim 1, wherein the setting angle of each strip-shaped active element has the same size.

3. The apparatus according to claim 1, wherein the strip-shaped active elements, seen in cross-section, possess a trapezoid shape, which is delimited, toward the outside, by a front side surface in a direction of rotation, an opposite side surface, and the planar pressure surface that connects the two side surfaces, wherein both side surfaces are disposed at a respective inclination angle relative to a respective radius line that runs through the edge formed by an intersection point of the respective side surface and the adjacent planar pressure surface that lies at the top, and wherein the inclination angles of the respective side surfaces are different from each other, so that the trapezoid shape of the strip-shaped active elements, seen in cross-section, is a non-symmetrical trapezoid shape.

4. The apparatus according to claim 1, wherein the strip-shaped active elements, seen in cross-section, possess a trapezoid shape, which is delimited, toward the outside, by a front side surface in a direction of rotation, an opposite side surface, and the planar pressure surface that connects the two side surfaces, wherein both side surfaces are disposed at a respective inclination angle relative to a respective radius line that runs through the edge formed by an intersection point of the respective side surface and the adjacent planar pressure surface that lies at the top, and wherein the inclination angles of the respective side surfaces are identical to each other, so that the trapezoid shape of the strip-shaped active elements, seen in cross-section, is a symmetrical trapezoid shape.

5. The apparatus according to claim 1, wherein the strip-shaped active elements, seen in cross-section, possess a trapezoid shape, which is delimited, toward the outside, by a front side surface in a direction of rotation, an opposite side surface, and the planar pressure surface that connects the two side surfaces, wherein both side surfaces are disposed at a respective inclination angle relative to a respective radius line that runs through the edge formed by an intersection point of the respective side surface and the adjacent planar pressure surface that lies at the top, and wherein the side surfaces are disposed at different absolute inclination angles relative to a radius line that symmetrically divides the planar pressure surface, so that the trapezoid shape of the strip-shaped active elements, seen in cross-section, is a non-symmetrical trapezoid shape.

6. The apparatus according to claim 1, wherein the strip-shaped active elements, seen in cross-section, possess a trapezoid shape, which is delimited, toward the outside, by a front side surface in a direction of rotation, an opposite side surface, and the planar pressure surface that connects the two side surfaces, wherein both side surfaces are disposed at a respective inclination angle relative to a respective radius line that runs through the edge formed by an intersection point of the respective side surface and the adjacent planar pressure surface that lies at the top, and wherein the side surfaces are disposed at an identical absolute inclination angle relative to a radius line that symmetrically divides the planar pressure surface, so that the trapezoid shape of the strip-shaped active elements, seen in cross-section, is a symmetrical trapezoid shape.

7. The apparatus according to claim 1, wherein each strip-shaped active element, with reference to the groove, has a height between 2 to 6 mm.

8. The apparatus according to claim 1, wherein each strip-shaped active element, with reference to the groove, has a height between 2 to 5 mm.

9. The apparatus according to claim 3, wherein the inclination angle of the front side surface lies in a value range between 8° and 12°.

10. The apparatus according to claim 9, wherein an angle between the front side surface of one active element and of the opposite side surface of a next active element in the direction of rotation lies in a value range between 54° and 62°.

11. The apparatus according to claim 4, wherein the inclination angle of the front side surface lies in a value range between 25° and 40°.

12. The apparatus according to claim 11, wherein an angle between the front side surface of one active element and of the opposite side surface of a next active element in the direction of rotation lies in a value range between 82° and 95°.

13. The apparatus according to claim 1, wherein the strip-shaped active elements, seen in cross-section, possess a trapezoid shape, which is delimited, toward the outside, by a front side surface in a direction of rotation, an opposite side surface, and the planar pressure surface that connects the two side surfaces, wherein both side surfaces are disposed at a respective inclination angle relative to a respective radius line that runs through the edge formed by an intersection point of the respective side surface and the adjacent planar pressure surface that lies at the top, and wherein both side surfaces are disposed at a respective groove inclination angle relative to a respective radius line that runs through the edge formed by an intersection point of the respective side surface and the adjacent planar groove root.

14. The apparatus according to claim 13, wherein the groove inclination angles of the respective side surfaces are different from each other.

15. The apparatus according to claim 13, wherein the groove inclination angles of the respective side surfaces are identical to each other.

16. An apparatus for compaction of containers, comprising two pressure rolls, disposed at a parallel distance from one another, forming a gap, which rolls can rotate about their axis of rotation, in each instance, and rotate in opposite directions, wherein their mantle surface has multiple essentially strip-shaped elements, in each instance, which reach longitudinally from one face surface to the opposite face surface of the pressure rolls, wherein the strip-shaped elements of each pressure roll are strip-shaped active elements, which each diverge at a setting angle relative to a reference line that runs parallel to its axis of rotation in the mantle surface, wherein for one pressure roll, the strip-shaped elements diverge with said setting angle of said strip-shaped element in a rotation direction of the one pressure roll from the reference line while with the other pressure roll, the strip-shaped elements diverge with said setting angle of said strip-shaped element against the rotation direction of the other pressure roll, so that the strip-shaped elements are crosswise to each other when adjacent to the gap, wherein longitudinal grooves are disposed in the mantle surface of each pressure roll, wherein a strip-shaped active element lies between two grooves, in each instance, wherein the strip-shaped elements of one of the pressure rolls comprise grooves separating each strip-shaped element into at least two segments; and wherein the strip-shaped elements of the other one of the pressure rolls does not comprise grooves separating each strip-shaped element into at least two segments.

17. The apparatus according to claim 16, wherein each groove comprises a planar groove root and each strip-shaped element comprises a planar pressure surface, wherein a width of each planar pressure surface is smaller than a width of each planar groove root, wherein the strip-shaped active elements, seen in cross-section, possess a trapezoid shape, which is delimited, toward the outside, by a front side surface in a direction of rotation, an opposite side surface, and the planar pressure surface that connects the two side surfaces, and wherein both side surfaces are disposed at a respective inclination angle relative to a respective radius line that runs through the edge formed by an intersection point of the respective side surface and the adjacent planar pressure surface that lies at the top.

* * * * *